US010919672B2

(12) United States Patent
Valderrama et al.

(10) Patent No.: US 10,919,672 B2
(45) Date of Patent: Feb. 16, 2021

(54) SEAL INDICATION MECHANISM FOR CONTAINERS

(75) Inventors: Vincent Valderrama, Stamford, CT (US); Stuart Naft, Fairfield, CT (US)

(73) Assignee: ANGELCARE FEEDING USA, LLC, Newark, DE (US)

( * ) Notice: Subject to any disclaimer, the term of this patent is extended or adjusted under 35 U.S.C. 154(b) by 0 days.

(21) Appl. No.: 12/411,752

(22) Filed: Mar. 26, 2009

(65) Prior Publication Data

US 2009/0242562 A1 Oct. 1, 2009

Related U.S. Application Data

(60) Provisional application No. 61/072,482, filed on Mar. 31, 2008.

(51) Int. Cl.
*B65D 43/02* (2006.01)

(52) U.S. Cl.
CPC ..... *B65D 43/0231* (2013.01); *B65D 2251/01* (2013.01); *B65D 2251/04* (2013.01); *B65D 2543/00092* (2013.01); *B65D 2543/00296* (2013.01); *B65D 2543/00351* (2013.01); *B65D 2543/00527* (2013.01); *B65D 2543/00537* (2013.01); *B65D 2543/00842* (2013.01)

(58) Field of Classification Search
CPC ..... B65D 43/0231; B65D 41/0471; B65D 2251/01; B65D 2251/04
USPC ..... 215/230, 330, 229; 220/288, 780, 229
See application file for complete search history.

(56) References Cited

U.S. PATENT DOCUMENTS

| | | | | |
|---|---|---|---|---|
| 486,996 | A | 11/1892 | Whitford et al. | |
| 584,102 | A | 6/1897 | Baker | |
| 609,527 | A | 8/1898 | Wilhelm et al. | |
| 690,528 | A | 8/1898 | Wilson | |
| 2,434,611 | A * | 1/1948 | Hamiel | 215/11.5 |
| D193,638 | S | 9/1962 | Goldstein et al. | D58/8 |
| 3,073,320 | A * | 1/1963 | Seaver | A45D 34/046 132/317 |
| 3,139,064 | A * | 6/1964 | Jean-Louis Harle | 116/309 |

(Continued)

FOREIGN PATENT DOCUMENTS

| | | |
|---|---|---|
| CN | 2484949 Y | 4/2002 |
| CN | 2762807 Y | 3/2006 |

(Continued)

OTHER PUBLICATIONS

Office Action from corresponding Application in Taiwan (97305647).

(Continued)

*Primary Examiner* — Andrew T Kirsch
(74) *Attorney, Agent, or Firm* — Norton Rose Fulbright US LLP

(57) ABSTRACT

A seal indication mechanism for a container assembly having a container and a lid is provided. The seal indication mechanism has a portion on the container and a portion on the lid that interface to indicate to a user that a seal has been achieved between the container and the lid. The seal indication mechanism provides an audible, tactile and visual indication to the user that the lid and container are sealed. The seal indication mechanism functions to indicate a range of sealed relative positions between the container and the lid throughout the usable life of the container assembly.

44 Claims, 11 Drawing Sheets

(56) References Cited

U.S. PATENT DOCUMENTS

| | | | | |
|---|---|---|---|---|
| 3,232,466 | A * | 2/1966 | Turanciol | 215/11.5 |
| D216,096 | S | 11/1969 | Lawton | D9/140 |
| D220,560 | S | 4/1971 | Johnson | D9/118 |
| 3,741,421 | A * | 6/1973 | Wittwer | 215/217 |
| 3,757,979 | A * | 9/1973 | Berghahn | 215/225 |
| 4,116,350 | A | 9/1978 | Allasia | |
| 4,121,731 | A | 10/1978 | Okerstrum | |
| 4,138,029 | A * | 2/1979 | Mahoney | 215/230 |
| 4,230,232 | A * | 10/1980 | Atkins | B65D 41/04 215/330 |
| 4,289,248 | A * | 9/1981 | Lynn | 215/330 |
| 4,485,963 | A | 12/1984 | Panicci | |
| 4,489,834 | A | 12/1984 | Thackrey | |
| D280,289 | S | 8/1985 | Aldrich et al. | D9/338 |
| 4,534,477 | A * | 8/1985 | Laub, III | B65D 55/02 215/215 |
| 4,662,530 | A * | 5/1987 | Goncalves | B65D 41/04 215/330 |
| 4,664,273 | A | 5/1987 | Simon | 215/216 |
| 4,691,833 | A * | 9/1987 | Ahrens | B65D 41/0492 215/227 |
| 4,723,673 | A * | 2/1988 | Tartaglia et al. | 215/230 |
| 4,770,308 | A * | 9/1988 | Lynn | 215/330 |
| 4,884,717 | A | 12/1989 | Bussard et al. | |
| D307,238 | S | 4/1990 | May | D9/352 |
| 5,038,948 | A | 8/1991 | Signorini | |
| D322,224 | S | 12/1991 | Miner | D7/511 |
| 5,102,000 | A | 4/1992 | Feltman, III | |
| 5,145,080 | A * | 9/1992 | Imbery, Jr. | B65D 41/0471 215/216 |
| 5,147,066 | A | 9/1992 | Snider | |
| D330,860 | S | 11/1992 | Gatrost | D9/529 |
| 5,186,344 | A | 2/1993 | Cook | 215/330 |
| 5,211,298 | A | 5/1993 | Bloch | |
| 5,211,303 | A | 5/1993 | Mosior | |
| 5,213,225 | A * | 5/1993 | King | B65D 41/0471 215/214 |
| 5,271,512 | A * | 12/1993 | Ekkert | 215/252 |
| 5,292,017 | A * | 3/1994 | Reifers | 215/206 |
| 5,299,701 | A | 4/1994 | Barker et al. | |
| 5,320,236 | A * | 6/1994 | Gregory | 215/344 |
| 5,439,125 | A | 8/1995 | Bloch | |
| 5,480,043 | A | 1/1996 | Wingo | |
| 5,617,968 | A | 4/1997 | Luburic | 220/276 |
| D381,042 | S | 7/1997 | Roche | D19/51 |
| 5,803,287 | A * | 9/1998 | Kusz | 215/330 |
| 5,865,330 | A * | 2/1999 | Buono | B65D 50/046 215/216 |
| 5,894,952 | A | 4/1999 | Mendenhall et al. | |
| 5,938,054 | A * | 8/1999 | Loader | 215/206 |
| 5,971,154 | A | 10/1999 | Toren | 206/534 |
| 5,988,412 | A * | 11/1999 | Minnette et al. | 215/216 |
| 6,039,197 | A | 3/2000 | Braun | |
| D428,813 | S | 8/2000 | Haley | |
| 6,095,382 | A * | 8/2000 | Gross | 222/520 |
| 6,102,245 | A | 8/2000 | Haberman | |
| 6,112,926 | A | 9/2000 | Fishman | |
| 6,142,335 | A | 11/2000 | Query, Jr. | |
| 6,325,236 | B1 | 12/2001 | Wong | |
| 6,394,302 | B1 | 5/2002 | Query, Jr. | |
| 6,431,380 | B1 * | 8/2002 | Branson | 215/206 |
| D465,971 | S | 11/2002 | Renz | D7/523 |
| 6,508,379 | B1 | 1/2003 | Van De Pol-Klein Nagelvoort et al. | |
| D471,110 | S | 3/2003 | Booth et al. | D9/529 |
| D471,458 | S | 3/2003 | Booth et al. | D9/504 |
| D483,611 | S | 12/2003 | Ghanem | D7/523 |
| 6,656,514 | B1 | 12/2003 | Tubbs | |
| D486,996 | S | 2/2004 | Karp | |
| 6,722,513 | B1 | 4/2004 | Flood et al. | |
| 6,758,358 | B1 * | 7/2004 | Bloom | 215/206 |
| 6,783,020 | B2 | 8/2004 | Featherston et al. | |
| 6,811,047 | B1 | 11/2004 | Hicks et al. | |
| 6,880,713 | B2 | 4/2005 | Holley, Jr. | |
| 6,883,672 | B2 * | 4/2005 | Dunn et al. | 215/11.5 |
| 6,902,079 | B2 | 6/2005 | Hagano | |
| 6,907,121 | B1 | 6/2005 | Anderson | |
| 6,910,595 | B2 | 6/2005 | Renz | |
| D514,942 | S | 2/2006 | Weber | D9/529 |
| 7,021,486 | B1 * | 4/2006 | Hurlbut | 220/379 |
| 7,040,497 | B2 * | 5/2006 | Weiler et al. | 215/277 |
| 7,178,685 | B2 * | 2/2007 | Hidalgo et al. | 220/229 |
| 7,234,136 | B2 | 6/2007 | Tirumalai et al. | |
| 7,303,086 | B2 | 12/2007 | Nhan et al. | |
| D559,112 | S | 1/2008 | Hyde et al. | D9/538 |
| 7,331,479 | B2 | 2/2008 | Oh | 215/332 |
| D582,723 | S | 12/2008 | Renz et al. | D7/523 |
| D583,240 | S | 12/2008 | Bourne | D9/500 |
| D583,671 | S | 12/2008 | Bourne | D9/500 |
| D584,102 | S | 1/2009 | Valderrama et al. | |
| 7,500,576 | B1 | 3/2009 | Alvarez | |
| D606,873 | S | 12/2009 | Fischer | D9/573 |
| 7,651,005 | B2 | 1/2010 | Nguyen et al. | |
| D609,527 | S | 2/2010 | Roehrig et al. | |
| D609,528 | S | 2/2010 | Roehrig et al. | |
| D612,250 | S | 3/2010 | Shah | D9/538 |
| 7,677,421 | B2 | 3/2010 | Lindsay | |
| 7,766,166 | B2 | 8/2010 | Cognome Dotta | |
| 7,832,600 | B2 | 11/2010 | Lindsay | |
| 8,403,160 | B2 * | 3/2013 | Hentzel | 215/331 |
| 2002/0066741 | A1 | 6/2002 | Rees | |
| 2002/0139767 | A1 | 10/2002 | Budd | |
| 2003/0066839 | A1 | 4/2003 | Connors, Jr. et al. | |
| 2003/0085232 | A1 | 5/2003 | Leinenweber | |
| 2004/0000551 | A1 | 1/2004 | Flink et al. | |
| 2004/0002008 | A1 | 1/2004 | Hegel et al. | |
| 2004/0055989 | A1 | 3/2004 | Harper et al. | |
| 2004/0099674 | A1 | 5/2004 | McDonough et al. | |
| 2004/0124196 | A1 | 7/2004 | Ziegler | |
| 2005/0133475 | A1 | 6/2005 | Goto et al. | |
| 2005/0263523 | A1 | 12/2005 | Moss | |
| 2006/0006182 | A1 | 1/2006 | Raft | |
| 2006/0213912 | A1 | 9/2006 | Zaytoun | |
| 2006/0283763 | A1 | 12/2006 | Beaty | |
| 2007/0090081 | A1 | 4/2007 | Briscoe et al. | |
| 2007/0138121 | A1 | 6/2007 | Stribling et al. | |
| 2007/0144999 | A1 * | 6/2007 | King | 215/330 |
| 2008/0073342 | A1 | 3/2008 | Cai | |
| 2008/0110850 | A1 * | 5/2008 | Tilton | 215/330 |
| 2008/0116202 | A1 * | 5/2008 | Auer et al. | 220/203.02 |
| 2008/0314914 | A1 | 12/2008 | Hacsi | |
| 2009/0071926 | A1 | 3/2009 | Berkovitch et al. | |
| 2009/0242562 | A1 * | 10/2009 | Valderrama et al. | 220/288 |

FOREIGN PATENT DOCUMENTS

| | | | |
|---|---|---|---|
| CN | 201150659 | Y | 11/2008 |
| EM | 000062906-0001 | | 8/2003 |
| EP | 1561406 | A1 | 8/2005 |
| EP | 1574155 | A2 | 9/2005 |
| GB | 2317608 | A | 4/1998 |
| JP | 10127733 | A | 5/1998 |
| JP | 2006008187 | A | 1/2006 |
| JP | D 1317658 | | 11/2007 |
| JP | D1316442 | | 12/2007 |
| NL | 1010555 | C2 | 5/2000 |
| NL | 1027064 | C2 | 3/2006 |
| TW | 325357 | | 1/1998 |
| TW | D100383 | | 1/2008 |
| WO | WO200026100 | A1 | 5/2000 |
| WO | WO2003018422 | | 6/2003 |
| WO | WO2006043035 | A1 | 4/2006 |

OTHER PUBLICATIONS

International Search Report dated Jul. 20, 2009 for corresponding PCT application No. PCT/US2009/001994.

Written Opinion dated Jul. 20, 2009 for corresponding PCT application No. PCT/US2009/001994.

Search Report from corresponding Taiwanese Patent Application No. 098303502.

(56) References Cited

OTHER PUBLICATIONS http://abbottnutrition.com/Products/similac-simply-smart, Similac Simply Smart, Abbott Nutrition for Healthcare Professionals, 2011 (2 pages).
http://similac.com/baby-formula/baby-bottle, New Similac SimplySmart baby bottle, 2011 (3 pages).
Office Action dated Feb. 7, 2013 From Corresponding Canadian Application No. 2,720,098.
Notification of Third Office Action dated Mar. 1, 2013 From Corresponding Chinese Application No. 200980112072.2.
Munchkin Snack Catcher—first use in Commerce Sep. 30, 2006.
Examination Report dated Aug. 9, 2012 From Canadian Application No. 2,720,098.
First Office Action dated Mar. 5, 2013 From Corresponding Chinese Application No. 2011-502950.
Canadian Office Action dated Jul. 9, 2013 from corresponding Canadian Application No. 2,720,098, 4 pages.

* cited by examiner

SEAL INDICATION MECHANISM FOR CONTAINERS

This application claims the benefit of U.S. Provisional Patent Application Ser. No. 61/072,482 filed on Mar. 31, 2008, the contents of which are incorporated by reference herein.

BACKGROUND OF THE INVENTION

1. Field of the Invention

The present disclosure relates generally to a seal indication mechanism for a lid and container assembly. More particularly, the present disclosure relates to a seal indication mechanism for a lid and container assembly with interfacing components on the lid and the container. Still more particularly, the present disclosure relates to a seal indication mechanism for a lid and container assembly with interfacing components on the lid and the container that provide an audible, tactile and visual indication that the lid and container are sealed.

2. Description of Related Art

Consumers sometimes have containers that leak or spill even though they may be leak or spill-proof containers. The tendency for containers to leak is generally caused by misuse. When a container thread design requires more than one turn, users are likely to stop turning the lid before a proper seal is created between the lid and container. Accordingly, there is a need for a container and lid design that provides for an indication to a user that a seal has been achieved between the lid and the container to prevent leaks and spills.

SUMMARY OF THE INVENTION

The present disclosure provides for a seal indication mechanism disposed on a container and lid assembly that provides feedback to a user to indicate that the required torque to seal the container and lid assembly has been applied.

The present disclosure also provides for a seal indication mechanism for a container and lid assembly that is closed using mating threads on reciprocal surfaces thereof, to indicate that a seal has been achieved.

The present disclosure also provides for a seal indication mechanism disposed on a container and lid assembly that provides audible, tactile and visual feedback to the user after the required torque to seal the container and lid assembly has been applied.

The present disclosure further provides for a seal indication mechanism disposed on a container and lid assembly in which the container and lid each have at least one interfacing member thereon. After relative movement between the interfacing members, a seal is achieved. Further, visual indication is provided to the user that a seal has been achieved over a range of relative positions between the lid and the container.

The present disclosure yet further provides for a seal indication mechanism disposed on a lid and container assembly that indicates a range of sealed positions between the lid and the container.

The present disclosure still yet further provides for a seal indication mechanism disposed on a container and lid assembly in which the lid has a detent that interfaces with at least one rib on the container to provide an audible, visual and tactile indication to the user that a seal has been created between the lid and the container after movement of the detent over the rib.

The present disclosure yet still further provides for a seal indication mechanism disposed on a container and lid assembly having a visual indication that there exists a seal between the container and the lid.

The present disclosure also provides for a seal indication mechanism disposed on a container and lid assembly that functions to compensate for changes in relative sealed positions between the lid and the container caused by usage.

A seal indication mechanism for a container assembly having a container and a lid is provided. The seal indication mechanism has a portion on the container and a portion on the lid that interface to indicate to a user that a seal has been achieved between the container and the lid. The seal indication mechanism provides an audible, tactile and visual indication to the user that the lid and container are sealed. The seal indication mechanism functions to indicate a range of sealed relative positions between the container and the lid throughout the usable life of the container assembly.

A seal indication mechanism for an assembly having a container and a lid secured by mating threads is provided. The mechanism provides for a marking disposed in an outer surface of the lid and a marking disposed on a perimeter of the container. The marking on the lid has a centerline that intersects with the marking disposed on the perimeter of the container during relative movement between the lid and the container to provide a visible indication of a sealed relationship between the lid and the container.

BRIEF DESCRIPTION OF THE DRAWINGS

Other and further benefits, advantages and features of the present disclosure will be understood by reference to the following specification in conjunction with the accompanying drawings, in which like reference characters denote like elements of structure.

DETAILED DESCRIPTION OF THE INVENTION

Figure 1:
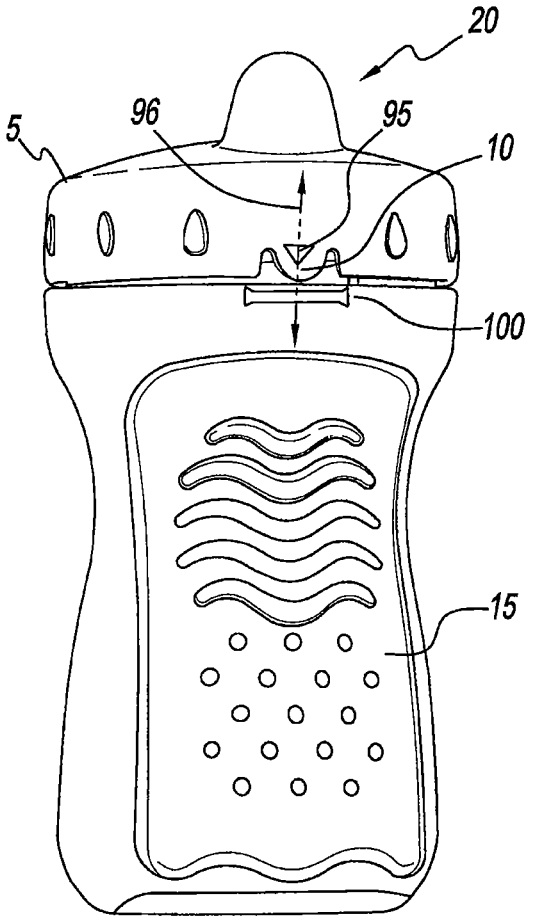
FIG. 1 illustrates a perspective view of the a seal indication mechanism disposed on a cup and lid assembly, according to a first embodiment of the present disclosure.

Referring to the figures and in particular to FIG. 1, a seal indication mechanism for a container and lid assembly of the present disclosure is shown, and generally referenced by reference numeral 10. Seal indication mechanism 10 is disposed on a container and lid assembly such as a cup and lid assembly 20 according to a first embodiment of the present invention. Cup and lid assembly 20 has a cup 15 and lid 5. Lid 5 is shown as having a spout; however, lid 5 could also be configured to receive a straw.

Figure 2:
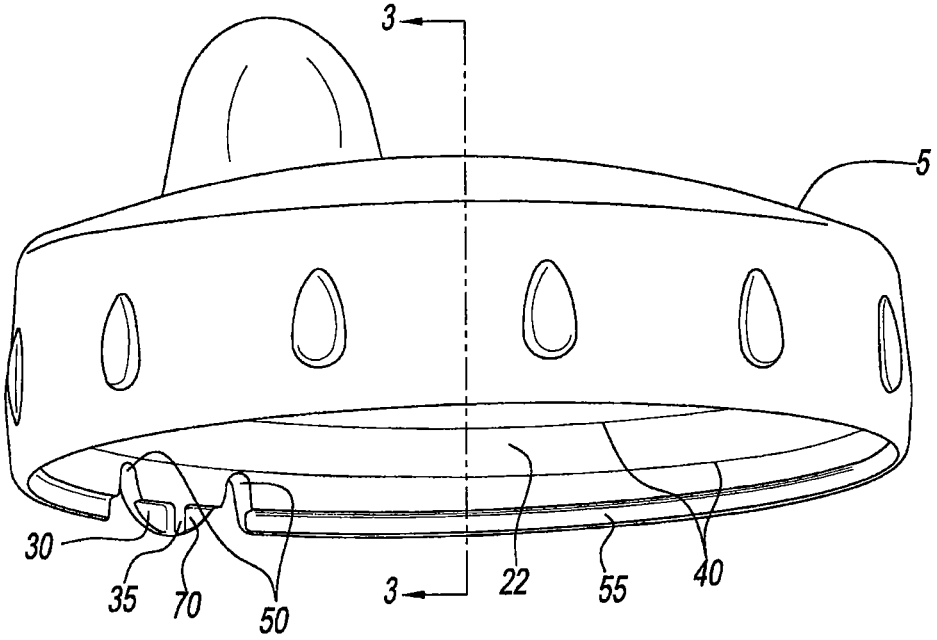
FIG. 2 illustrates a bottom perspective view of the lid FIG. 1 showing the detent of the seal indication mechanism of the present disclosure.
Figure 5:
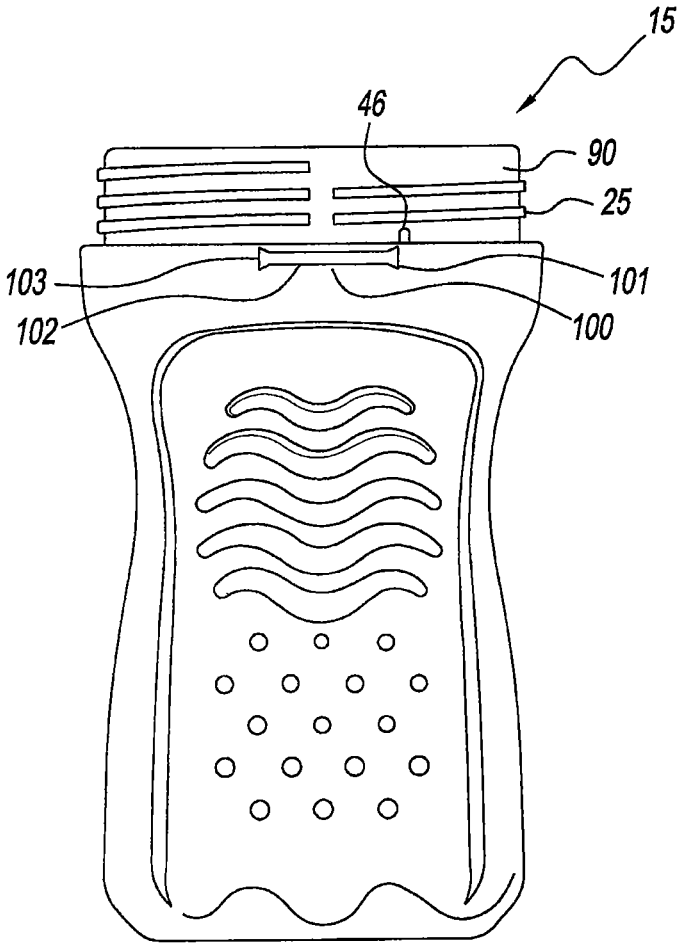
FIG. 5 illustrates a front view of the cup of FIG. 1 showing the rib of the seal indication mechanism.

Referring to FIGS. 1, 2 and 5, seal indication mechanism 10 is a two-part mechanism having interfacing components on cup 15 and lid 5. Seal indication mechanism 10 has a portion on lid 5 that is tab a 30 having a detent 35. Seal indication mechanism 10 has second portion, namely a rib 46, that is disposed on annular lip 90 or perimeter of cup 15. Detent 35 and rib 46 on cup 15 are integrally molded. Additionally, marking 95 on lid 5 and marking 100 on cup 15 provide further indication that a seal between lid 5 and cup 15 is achieved.

Lid 5 has threads 40 on an internal surface 22 thereof. Cup 15 has threads 25 on an annular lip 90 that mate with threads 40. Lid 5 and cup 15 are rotated together in a traditional fashion to have a mating relationship, as shown in FIG. 1, to seal cup and lid assembly 20 to prevent spilling or leakage of contents.

Figure 3:
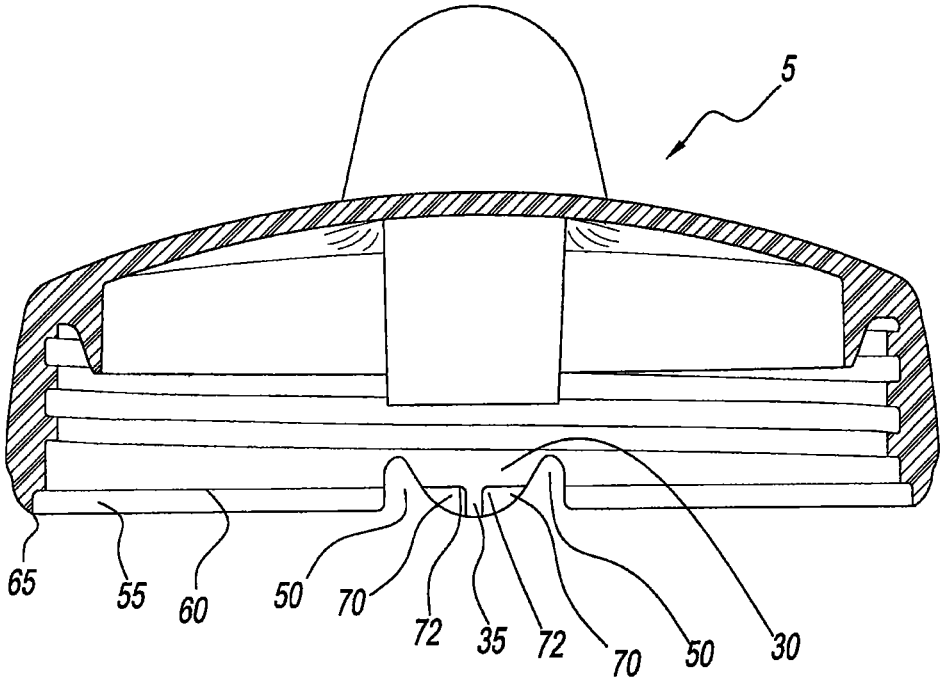
FIG. 3. illustrates a section view of the lid of FIG. 2 according to the present disclosure, shown along line 3-3.
Figure 4:
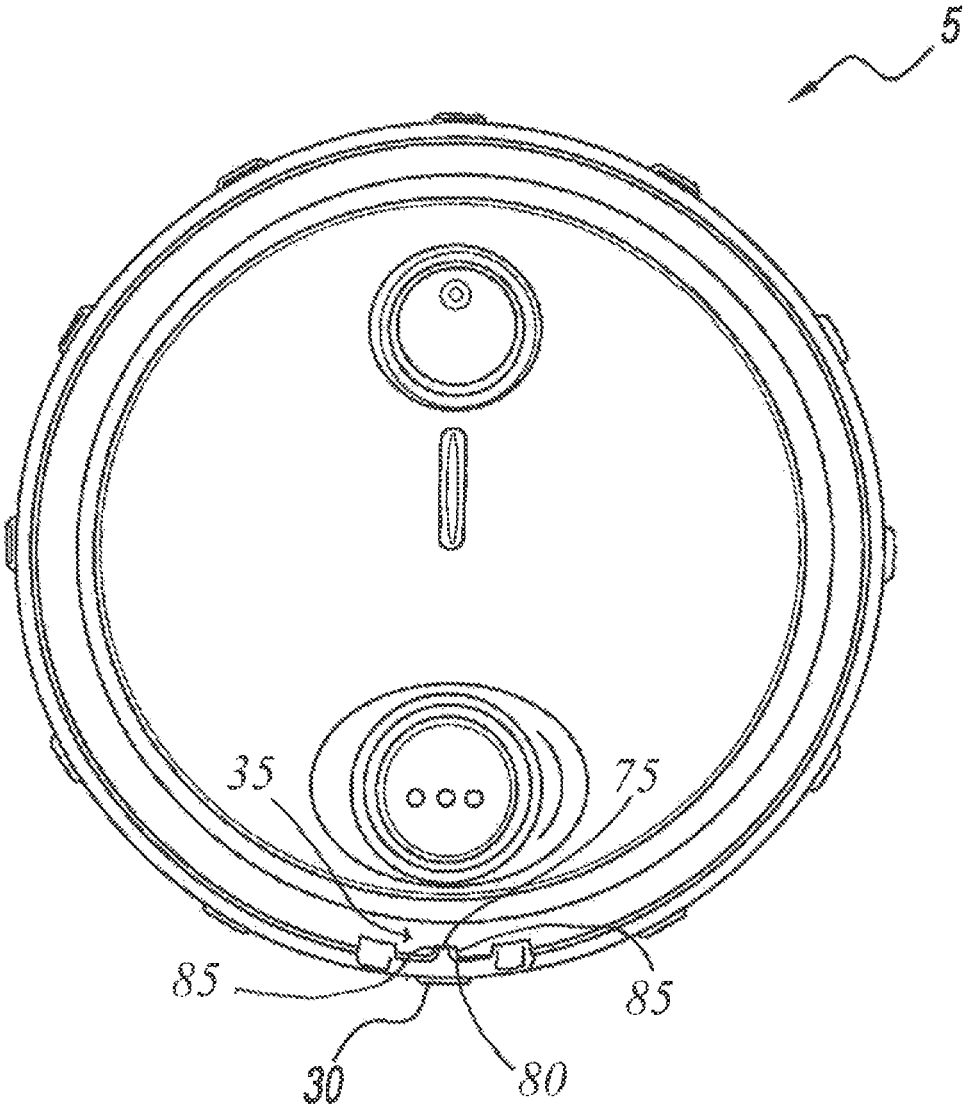
FIG. 4 illustrates a bottom view of the lid of FIG. 2 showing the detent of the seal indication mechanism.

Referring to FIGS. 2 and 3, lid 5 has two channels 50 that are disposed on opposite sides of tab 30. Internal surface 22 has an annular step 55 that has an upper portion 60 and a lower portion 65. Upper portion 60 is spaced from lower portion 65 by approximately 0.04 inches. Step 55 is molded on the inner surface of lid 5, to ensure that detent 35 will not interfere with threads 25 as user assembles cup and lid assembly 20. Tab 30 has recesses 70 that are on opposite sides of detent 35. Recesses 70 each have an upper ridge 72 that is contiguous with upper portion 60 of annular step 55. Detent 35 is perpendicular with respect to upper ridge 72 of recesses 70. Referring to FIG. 4, detent 35 has a trapezoidal shape. Facing surface 75 of detent 35 has a width of approximately 0.04 inches. Detent 35 has a base 80 having a width of approximately 0.08 inches. The sides 85 of detent are each at an angle of approximately 15 degrees relative to a center line of detent 35.

Figure 6:
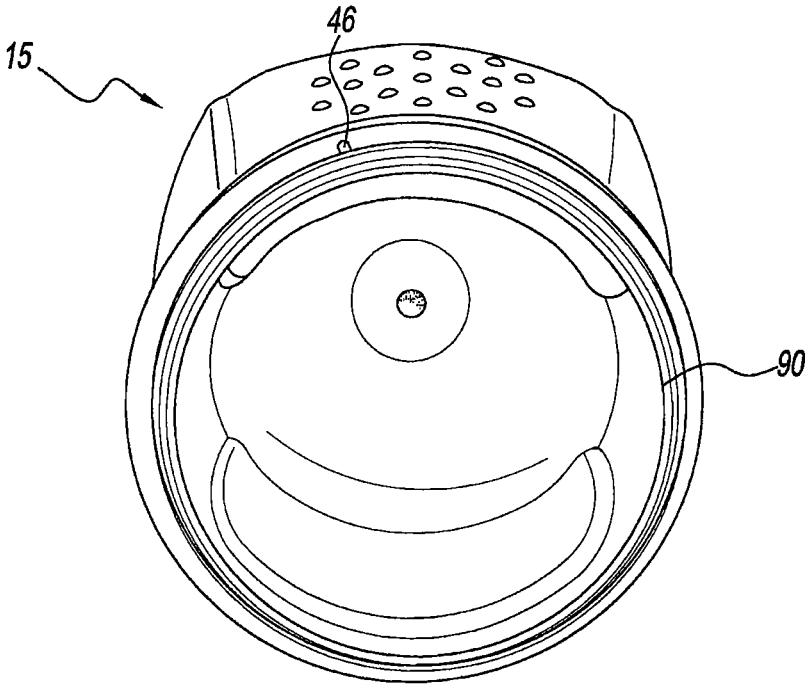
FIG. 6 illustrates a top view of the cup of FIG. 1 showing the rib of the seal indication mechanism.

Referring to FIGS. 5 and 6, cup 15 has a rib 46 positioned on annular lip 90. Rib 46 is radially positioned on the perimeter of cup 15 as measured from a vertical axis of cup 15. Rib 46 has a radius against annular lip 90 on which threads 25 are disposed. The radius on rib 46 and the angled sides 85 of detent 35 permit movement of detent 35 over rib 46 while minimizing wear.

Rib 46 is molded at a predetermined position on annular lip 90. After the relative movement of detent 35 over rib 46, a sealed position between lid 5 and cup 15 exists. Additionally, marking 95, an arrow, on lid 5, points between marking 100 shown as a line 102 between arrow edge 101 and arrow edge 103 on cup 15 to provide further indication that a seal between lid 5 and cup 15 exists. Specifically, vertical centerline 96 through marking 95 intersects marking 100 to indicate a range of sealed positions between lid 5 and cup 15 as shown in FIG. 1. Thus, after movement of detent 35 over rib 46, a seal exists to cover a range of relative positions of sealing of cup and lid assembly 20.

Figure 7:
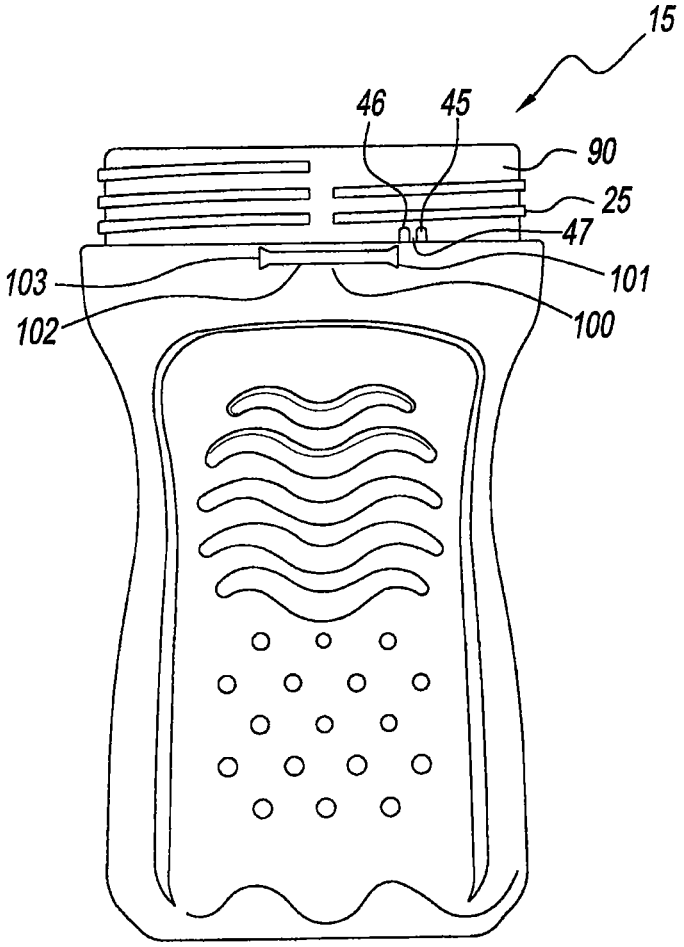
FIG. 7 illustrates a front view of the cup according to a second embodiment of the seal indication mechanism having two ribs.
Figure 8:
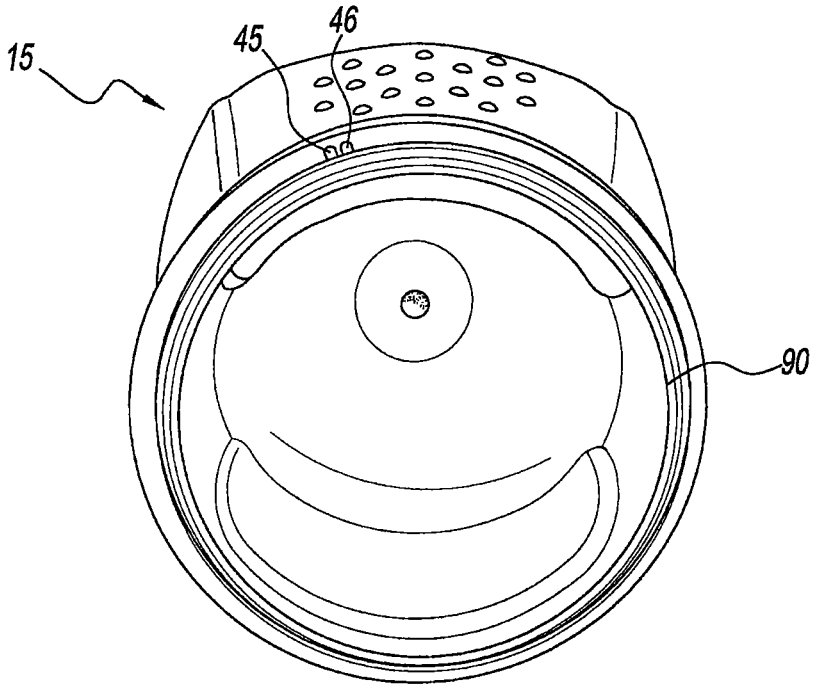
FIG. 8 illustrates a top view of the cup of FIG. 7 showing the second embodiment of the seal indication mechanism having two ribs.

Referring to FIGS. 7 and 8, a second embodiment of seal indication mechanism 10 is shown. Cup 15 has two ribs positioned on annular lip 90. Rib 45 and rib 46 are radially spaced from approximately 10 to 15 degrees around the perimeter of cup 15 as measured from a vertical axis of cup 15. Positioned between rib 45 and rib 46 is a surface 47 having a width of approximately 0.06 inches. Surface 47 permits detent 35 to rest between ribs 45 and 46. While cup 15 shows two ribs, cup 15 could have as many as four ribs. Thus, cup 15 is functional with at least one rib or with a plurality of ribs positioned as shown in FIGS. 7 and 8. Rib 45 and rib 46 each has a radius against annular lip 90 on which threads 25 are disposed. The radius on ribs 45 and 46 and the angled sides 85 of detent 35 permit movement of detent 35 over each rib while minimizing wear.

Rib 45 and rib 46 are molded at a predetermined position on annular lip 90. After the relative movement of detent 35 over rib 45 and rib 46, a sealed position between lid 5 and cup 15 exists. Additionally, marking 95, an arrow, on lid 5, points between marking 100 shown as a line 102 between arrow edge 101 and arrow edge 103 on cup 15 to provide further indication that a seal between lid 5 and cup 15 exists. Specifically, vertical centerline 96 through marking 95 intersects marking 100 to indicate a range of sealed positions between lid 5 and cup 15 as shown in FIG. 1. Thus, after movement of detent 35 over ribs 45 and 46, a seal exists to cover a range of relative positions of sealing of cup and lid assembly 20.

Referring to the first embodiment of FIGS. 5 and 6, the positions of rib 46 on cup 15 and detent 35 are placed after determining the location at which a seal is achieved in cup and lid assembly 20. Rib 46 and detent 35 are positioned accordingly on the cup 15 and lid 5, respectively. Thus, a seal is achieved over a range of relative lid 5 and cup 15 positions after detent 35 passes over rib 46. Similarly, with regard to the second embodiment of FIGS. 7 and 8, a seal is achieved after detent 35 passes over rib 45 and 46.

Further, rib 46 and detest 35, on cup 15 and lid 5, respectively, are positioned to maintain a seal between lid 5 and cup 15 throughout the usable life of lid and cup assembly 20. During the lifetime of cup and lid assembly 20, fatigue is caused by repeated washings that involve numerous heating cycles and detergents. Fatigue is also caused during use by numerous rotations for closing and opening of assembly 20 that may often be excessive. This fatigue and wear on cup 15 and lid 5 results in a shift of the relative position between lid 5 and cup 15 at which a seal will be created. The relative shift caused by this use is accommodated by the placement of marking 100 on cup. The location of marking 100 represents a predetermined range of sealed positions based upon the shift of the relative sealing positions between lid 5 and cup 15 when a predetermined amount of force is used to close cup and lid assembly 20.

The predetermined range of sealing positions was identified by estimating that approximately 25 inch-pounds (in-lbs) of torque would be required by a user to seal cup and lid assembly 20. Arrow edge 101 was initially placed at that location representing 25 in-lbs. Then after every five successive washing cycles, the cup and lid assembly 20 was closed using the same amount of torque. With the same amount of torque being applied to seal cup and lid assembly 20, a range of relative positions of sealing were recorded. Marking 100 was placed in the range of sealing positions.

Marking 100 begins with arrow edge 101 and ends with arrow edge 103. Rib 46 was positioned immediately in front of arrow end 101.

In operation, lid 5 and cup 15 are rotated relative to each other to close lid assembly 20, as shown at FIG. 7. Rib 46 does not interface with threads 40 as the user cup 15 and lid 5 are assembled. Similarly, detent 35 does not interfere with threads 25. During rotation, and after an application of a predetermined amount of force, detent 35 of lid 5 moves over rib 46. The amount of torque that is required to move detent 35 over rib 46 to marking 100 is approximately 25 in-lbs of force. This amount of force will ensure that the seal is achieved.

The user of the lid and cup assembly 20 will know that a seal is achieved in three ways. First, the user will feel resistance as detent 35 slides over rib 46. The instance of resistance will provide a tactile indication that a seal exists. Second, the user will hear the contact of detent 35 against cup 15 after it comes to rest after moving over rib 46 against annular rim 90 of cup. Third, the user can visually observe that a seal has been achieved by observing that marking 95 on lid 5 shaped as a downward pointing arrow, coincident with vertical centerline 96, points between arrow edge 101 and arrow edge 103 of marking 100 on cup 15. When lid marking 95 points between arrows, the user will know that a seal exists between lid 5 and cup 15. Thus, there are three types of ways by which a user is assured that a seal has been achieved. While the amount of force to move detent 35 to first arrow end 101 is approximately 25 in-lbs, the amount of force to move detent 35 past to arrow edge 103 is from 35 to 40 in-lbs. As the user tightens the lid, greater torque is required to turn the lid 5.

Figure 9:
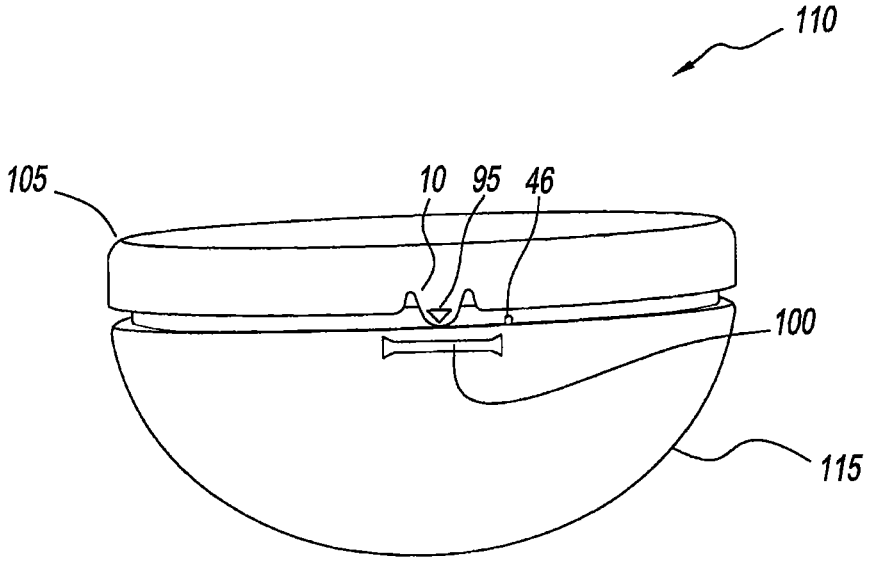
FIG. 9 illustrates the seal indication mechanism disposed on a bowl and lid assembly.

Referring to FIG. 9, seal indication mechanism 10 is shown on a bowl and lid assembly 110. Seal indication mechanism 10 on bowl and lid assembly operates in the same fashion as seal indication mechanism of cup and lid assembly 20 according to the first embodiment. Bowl and lid assembly 110 has a bowl 105 and a lid 115 that are connected by mating threads on opposing surfaces. Seal indication mechanism 10 of bowl and lid assembly 110 provides a visual, tactile and audible indication that a seal has been achieved after a predetermined amount of torque is applied. Bowl 115 and lid 105 each have visual markings 100 and 95, thereon, respectively, to provide further visual indication that a seal has been achieved between bowl 115 and lid 105. Bowl and lid assembly 110 could also have a second rib 45, according to the second embodiment of the present invention.

Figure 10:
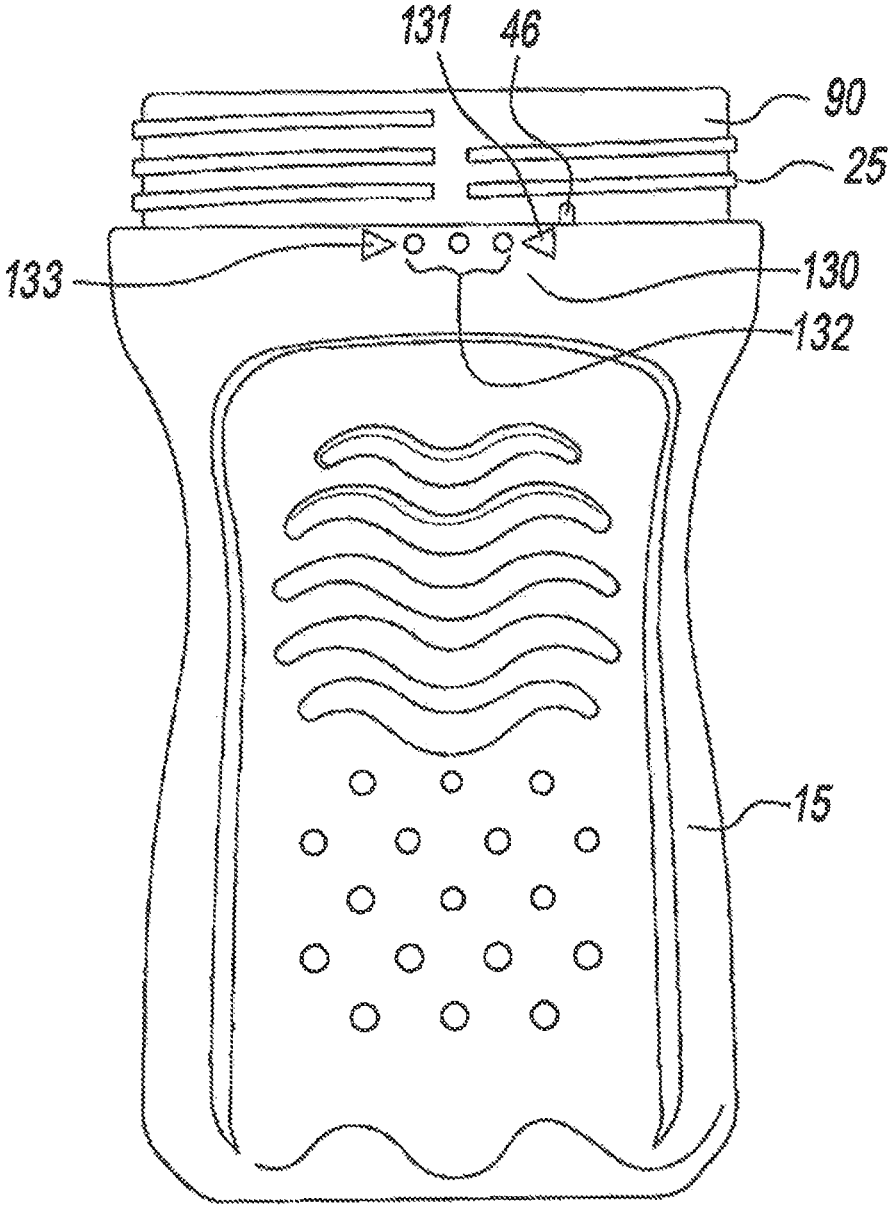
FIG. 10 illustrates a third embodiment of a seal indication mechanism disposed on a container according to the present disclosure.
Figure 11:
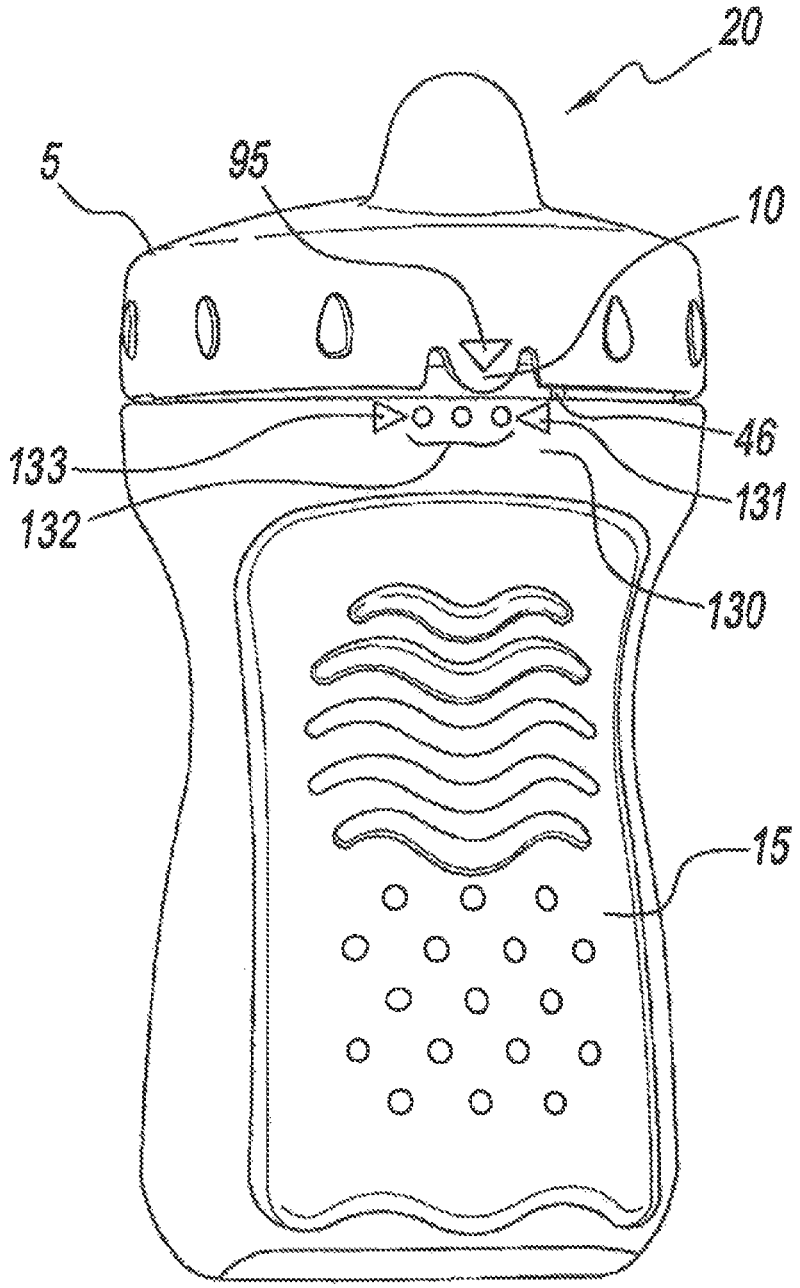
FIG. 11 illustrates the third embodiment of the seal indication mechanism disposed on a cup and lid assembly in a sealed relationship between the cup and lid.

In a third embodiment of sealing indication mechanism is shown in FIGS. 10 and 11. Lid 5 has marking 95, an inverted arrow. Cup 15 has a sealing range indicated by marking 130 as two arrows 131 and 133 with a series of dots 132 therebetween. In this embodiment, after detent 35 passes over rib 46, lid 5 is in the sealing range indicated by marker 130. When a centerline of marking 95 points between arrows 131 and 133 to series of dots 132 as seal is achieved. In this embodiment, an audible indication of sealing is provided by hearing an audible sound as detent 35 moves over rib 46. A tactile indication is provided as the user feels resistance as detent 35 moves over rib 46. A visual indication is provided by centerline of marking 95 pointing to series of dots 132 between arrows 131 and 133 on cup 15, identical to the embodiment of FIG. 1. The embodiment of FIGS. 10 and 11, can be configured to incorporate two ribs 45 and 46 as shown in FIGS. 7 and 8.

The cup and lid assembly 20 and bowl and lid assembly 110 are made from a material such as polypropylene or polyethylene or a similar hard plastic material appropriate for such purposes.

Seal indication mechanism 10 is shown for cup and lid assembly 20 and bowl and lid assembly 110; however, the disclosure has broad applicability to other types of lidded containers. Accordingly, seal indication mechanism 10 has broad applicability to a range of container and lid assemblies that have a threaded reciprocal relationship between the lid and container.

The present disclosure having been thus described with particular reference to the preferred forms thereof, it will be obvious that various changes and modifications may be made therein without departing from the spirit and scope of the present disclosure as defined in the disclosure and the claims.

We claim:

1. A cup assembly having a central vertical axis, comprising:

a lid having:

a circumferential sidewall extending between a first axial end and a second axial end, threads disposed on an internal surface of the circumferential sidewall, and a tab defined by the circumferential sidewall, the tab defined between a first channel and a second channel circumferentially spaced from the first channel, the first channel and the second channel extending through a thickness of the circumferential sidewall from the second axial end a portion of a distance between the second axial end and the first axial end, the tab having a detent projecting radially inward from the tab, the detent having a length extending along a detent vertical axis that is parallel to the central vertical axis; and a cup formed from a hard plastic material the cup comprising:

an annular lip having threads projecting radially outward from an external circumferential surface of the annular lip, and a rib projecting radially outward from the external circumferential surface of the annular lip, the rib having a length extending along a rib vertical axis that is parallel to the central vertical axis, wherein the threads of the lid and the threads of the cup are configured to be engaged to one another by rotating the cup and the lid in a rotational direction, relative to one another, such that the detent moves from a first circumferential position to a second circumferential position with respect to the cup, wherein the detent is configured to engage and slide radially over the rib at an intermediate position between the first circumferential position and the second circumferential position such that as the detent moves from the intermediate position to the second circumferential position in the rotational direction, a visual indication of a seal between the lid and the cup is provided by the cup and/or the lid, wherein the detent is axially spaced from the threads of the lid, and wherein the lid includes a port configured to permit the withdrawal of fluid through the port by suction force when the detent is in the second circumferential position.

2. The cup assembly of claim 1, wherein the threads of the lid and the threads of the cup are helical.

3. The cup assembly of claim 2, wherein the threads of the cup are discontinuous.

4. The cup assembly of claim 3, wherein the threads of the cup are discontinuous along a circumferential portion of the annular lip that is axially aligned with the rib.

5. The cup assembly of claim 1, wherein the detent has a trapezoidal shape, wherein the detent has a face surface that is opposite a base.

6. The cup assembly of claim 5, wherein the detent has a width of about 0.04 inches to about 0.08 inches between the face surface and the base.

7. The cup assembly of claim 1, wherein:

the cup defines a cup marking as the visual indication, the cup marking extending circumferentially away from the rib between a first end and a second end.

8. The cup assembly of claim 7, wherein:

the lid defines a lid marking as the visual indication, and the lid is configured such that after the detent passes the intermediate position in the rotational direction, the lid marking is aligned between the first end and the second end the cup marking to indicate the seal between the lid and the cup.

9. The cup assembly of claim 1, wherein the lid includes a circumferential ridge disposed between the first axial end and the second axial end on the internal surface of the circumferential sidewall, wherein an annular step extends from the second axial end to the ridge around the internal surface of the circumferential sidewall, and wherein the annular step has a first thickness that is less than a second thickness of the circumferential sidewall between the ridge and the first axial end.

10. The cup assembly of claim 9, wherein the annular step is axially spaced from the threads of the lid.

11. The cup assembly of claim 1, wherein:

the detent extends between the ridge and the second axial end of the circumferential sidewall.

12. The cup assembly of claim 11, wherein the annular step defines:

a first recess between the detent and the first channel and a second recess between the detent and the second channel.

13. The cup assembly of claim 1, wherein an axially outer end of the tab corresponding to the second axial end of the circumferential sidewall is configured to move from an inner radial position to an outer radial position and back to the inner radial position as the detent engages and slides radially over the rib at the intermediate position.

14. The cup assembly of claim 13, wherein the detent is configured to provide an audible indication of the seal between the lid and the cup as the detent moves back to the inner radial position from the outer radial position.

15. The cup assembly of claim 1, wherein the rib is axially spaced from the threads of the cup.

16. A cup assembly having a central vertical axis, comprising:

a lid having:

a circumferential sidewall extending between a first axial end and a second axial end, threads disposed on an internal surface of the circumferential sidewall, a circumferential ridge disposed between the first axial end and the second axial end on the internal surface of the circumferential sidewall, a tab, wherein the tab has a detent projecting radially inward from the tab, the detent extending between the ridge and the second axial end of the circumferential sidewall, the tab formed between a first channel and a second channel circumferentially spaced from the first channel, the first channel and the second channel extending through a thickness of the circumferential sidewall from the second axial end a portion of a distance between the second axial end and the first axial end, and an annular step extends from the second axial end to the ridge around the internal surface of the circumferential sidewall; and a cup formed from a hard plastic material, the cup comprising:

an annular lip having threads projecting radially outward from an external circumferential surface of the annular lip, a rib projecting radially outward from the external circumferential surface of the annular lip, and a cup marking extending circumferentially away from the rib between a first end and a second end, wherein the threads of the lid and the threads of the cup are configured to be engaged to one another by rotating the cup and the lid in a rotational direction, relative to one another, such that the detent moves from a first circumferential position to a second circumferential position with respect to the cup, wherein the detent is configured to engage and slide radially over the rib at an intermediate position between the first circumferential position and the second circumferential position thereby providing at least one indication of a seal between the lid and the cup, wherein the detent is configured such that further rotation of the detent from the intermediate position to the second circumferential position in the rotational direction moves the detent from the first end of the cup marking toward the second end;

wherein, the annular step has a first thickness that is less than a second thickness of the circumferential sidewall between the ridge and the first axial end and the annular step is axially spaced from the threads of the lid, and wherein the lid includes a port configured to permit the withdrawal of fluid through the port by suction force when the detent is in the second circumferential position.

17. The cup assembly of claim 16, wherein the threads of the lid and the threads of the cup are helical.

18. The cup assembly of claim 17, wherein the threads of the cup are discontinuous.

19. The cup assembly of claim 18, wherein:

the cup comprises a second rib projecting radially outward from the external circumferential surface of the annular lip; and the detent is configured to engage and slide radially over the rib and the second rib while moving from a first circumferential position to a second circumferential position.

20. The cup assembly of claim 19, wherein the first end of the cup marking is vertically aligned with at least a portion of the rib and the rib is disposed between the first end of the cup marking and the second rib.

21. The cup assembly of claim 20, wherein:

the lid defines a lid marking; and the lid and the cup are configured such that rotation of the detent from the intermediate position to the second circumferential position forms a seal between the lid and the cup, and aligns the lid marking between the first end and the second end of the cup marking to provide another indication of the seal.

22. The cup assembly of claim 16, wherein the detent has a tapered shape, wherein the detent has a face surface that is opposite a base.

23. The cup assembly of claim 22, wherein the detent has a width of about 0.04 inches to about 0.08 inches between the face surface and the base.

24. The cup assembly of claim 16, wherein the detent is axially spaced from the threads of the lid.

25. The cup assembly of claim 16, wherein the rib is axially spaced from the threads of the cup.

26. The cup assembly of claim 16, wherein the annular step defines a first recess between the detent and the first channel and a second recess between the detent and the second channel.

27. The cup assembly of claim 16, wherein the tab is formed between a first channel and a second channel circumferentially spaced from the first channel, the first channel and the second channel extending through a thickness of the circumferential sidewall from the second axial end a portion of a distance between the second axial end and the first axial end.

28. The cup assembly of claim 16, wherein an axially outer end of the tab corresponding to the second axial end of the circumferential sidewall is configured to move from an inner radial position to an outer radial position and back to the inner radial position as the detent engages and slides radially over the rib at the intermediate position.

29. The cup assembly of claim 28, wherein the detent is configured to provide an audible indication of the seal between the lid and the cup as the detent moves back to the inner radial position from the outer radial position.

30. A cup assembly having a central vertical axis, comprising:

a lid having:

a circumferential sidewall extending between a first axial end and a second axial end, the lid defining an opening at the second axial end, threads disposed on an internal surface of the circumferential sidewall, and a tab defined by the circumferential sidewall, the tab defined between a first channel and a second channel circumferentially spaced from the first channel, the first channel and the second channel extending through a thickness of the circumferential sidewall from the second axial end a portion of a distance between the second axial end and the first axial end, the tab having a detent projecting radially inward from the tab; and a cup formed from a hard plastic material, the cup comprising:

an annular lip having threads projecting radially outward from an external circumferential surface of the annular lip, and a rib projecting radially outward from the external circumferential surface of the annular lip, wherein the threads of the lid and the threads of the cup are configured to be engaged to one another by rotating the cup and the lid in a rotational direction, relative to one another, such that the detent moves from a first circumferential position to a second circumferential position with respect to the cup, wherein the detent is configured to engage and slide radially over the rib at an intermediate position between the first circumferential position and the second circumferential position thereby providing at least one indication of a seal between the lid and the cup, wherein an axially outer end of the tab corresponding to the second axial end of the circumferential sidewall is configured to move from an inner radial position to an outer radial position and back to the inner radial position as the detent engages and slides radially over the rib at the intermediate position, and wherein the lid includes a port configured to permit the withdrawal of fluid through the port by suction force when the detent is in the second circumferential position.

31. The cup assembly of claim 30, wherein the threads of the lid and the threads of the cup are helical.

32. The cup assembly of claim 31, wherein the threads of the cup are discontinuous.

33. The cup assembly of claim 32, wherein the threads of the cup are discontinuous along a circumferential portion of the annular lip that is axially aligned with the rib.

34. The cup assembly of claim 30, wherein the cup comprises a second rib projecting radially outward from the external circumferential surface of the annular lip.

35. The cup assembly of claim 30, wherein the detent has a tapered shape, wherein the detent has a face surface that is opposite a base.

36. The cup assembly of claim 35, wherein the detent has a width of about 0.04 inches to about 0.08 inches between the face surface and the base.

37. The cup assembly of claim 30, wherein the detent is axially spaced from the threads of the lid.

38. The cup assembly of claim 30, wherein the rib is axially spaced from the threads of the cup.

39. The cup assembly of claim 30, wherein the cup has a cup marking at least partially vertically aligned with the rib.

40. The cup assembly of claim 30, wherein the lid includes a circumferential ridge disposed between the first axial end and the second axial end on the internal surface of the circumferential sidewall, wherein an annular step extends from the second axial end to the ridge around the internal surface of the circumferential sidewall, and wherein the annular step has a first thickness that is less than a second thickness of the circumferential sidewall between the ridge and the first axial end.

41. The cup assembly of claim 40, wherein the annular step is axially spaced from the threads of the lid.

42. The cup assembly of claim 30, wherein:

the detent extends between the ridge and the second axial end of the circumferential sidewall.

43. The cup assembly of claim 42, wherein the annular step defines a first recess between the detent and the first channel and a second recess between the detent and the second channel.

44. The cup assembly of claim 30, wherein the detent is configured to provide an audible indication of the seal between the lid and the cup as the detent moves back to the inner radial position from the outer radial position.

* * * * *